US008925205B2

(12) United States Patent
Iwasaki et al.

(10) Patent No.: US 8,925,205 B2
(45) Date of Patent: Jan. 6, 2015

(54) ELECTRIC SHAVER

(75) Inventors: Jyuzaemon Iwasaki, Nagahama (JP); Hiroaki Shimizu, Hikone (JP); Noboru Kobayashi, Hikone (JP); Shunsuke Komori, Hikone (JP); Toshio Ikuta, Hikone (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 878 days.

(21) Appl. No.: 13/049,138

(22) Filed: Mar. 16, 2011

(65) Prior Publication Data

US 2011/0232097 A1 Sep. 29, 2011

(30) Foreign Application Priority Data

Mar. 26, 2010 (JP) ..... 2010-072274

(51) Int. Cl.

| | |
|---|---|
| ***B26B 19/20*** | (2006.01) |
| ***B26B 19/12*** | (2006.01) |
| ***B26B 19/42*** | (2006.01) |
| ***B26B 19/04*** | (2006.01) |
| ***B26B 21/54*** | (2006.01) |
| ***B26B 19/38*** | (2006.01) |

(52) U.S. Cl.

CPC ..... *B26B 19/384* (2013.01)
USPC ..... 30/34.2; 30/43.9; 30/346.55

(58) Field of Classification Search

CPC ..... B26B 19/384
USPC ..... 30/34.2, 41.9, 43, 43.6–43.9, 45, 30/346.51, 346.55
See application file for complete search history.

(56) References Cited

U.S. PATENT DOCUMENTS

| | | | | |
|---|---|---|---|---|
| 2,281,841 | A | 5/1942 | Holsclaw | |
| 2,877,548 | A * | 3/1959 | Starre | 30/346.51 |
| 4,035,914 | A | 7/1977 | Blume et al. | |
| 4,589,205 | A * | 5/1986 | Tanahashi | 30/43.8 |
| 4,998,352 | A | 3/1991 | Tietjens | |
| 5,119,558 | A | 6/1992 | Van Erp et al. | |
| 5,857,260 | A | 1/1999 | Yamada et al. | |
| 5,867,908 | A * | 2/1999 | Van Veen et al. | 30/43.6 |
| 2008/0134523 | A1 | 6/2008 | Komori et al. | |
| 2011/0179648 | A1 | 7/2011 | Sakon et al. | |

FOREIGN PATENT DOCUMENTS

| | | |
|---|---|---|
| CN | 1143558 | 2/1997 |
| CN | 200970785 | 11/2007 |
| CN | 201161397 | 12/2008 |

(Continued)

OTHER PUBLICATIONS

European Search Report on Jul. 6, 2011.

(Continued)

*Primary Examiner* — Kenneth E. Peterson
*Assistant Examiner* — Samuel A Davies
(74) *Attorney, Agent, or Firm* — Greenblum & Bernstein P.L.C.

(57) ABSTRACT

An electric shaver 1 includes: outer blades 8 having blade holes 50 defined by bars; and inner blades 13 which is provided inside of the outer blades 8 and moved relative to the outer blades 8 to cut body hair 71 inserted into the blade holes 50. A first bar 43 in which a skin contact surface 43*a* coming into contact with skin 70 is positioned on the inner blade 13 side of a skin contact surface 45*j* of a hair raising bar 45 is provided adjacent to and forward of the hair raising bar 45.

6 Claims, 19 Drawing Sheets

(56) References Cited

FOREIGN PATENT DOCUMENTS

| | | |
|---|---|---|
| CN | 102166757 | 8/2011 |
| DE | 1949521 | 4/1971 |
| EP | 0279088 | 8/1988 |
| EP | 1930137 | 6/2008 |
| FR | 0743144 | 11/1996 |
| JP | 58-117264 | 8/1983 |
| JP | 3-267090 | 11/1991 |
| JP | 3083548 | 6/2000 |
| JP | 2002-66169 | 3/2002 |

OTHER PUBLICATIONS

U.S. Appl. No. 13/009,226 to Shigetoshi Sakon et al., filed Jan. 19, 2011.

U.S. Appl. No. 13/049,369 to Noboru Kobayashi et al., filed Mar. 16, 2011.

China Office action, dated Feb. 27, 2013 along with an english translation thereof.

* cited by examiner

ELECTRIC SHAVER

CROSS REFERENCE TO RELATED APPLICATIONS

This application is based upon and claims the benefit of priority from prior Japanese Patent Application P2010-072274 filed on Mar. 26, 2010; the entire contents of which are incorporated by reference herein.

BACKGROUND OF THE INVENTION

The present invention relates to an electric shaver.

Various types of electric shavers to shave body hair have been developed. Herein, the angle between the direction that a body hair extends and the skin surface is called a hair rising angle. Body hair with large hair rising angle (45° to 60°, for example) is easy to shave, but body hair with small hair rising angle (not more than 30°, for example), or flat lying body hair is difficult to shave. An electric shaver as disclosed in Japanese Patent Publication No. 3083548 has been therefore developed, which is provided with hair raising portions at bars of an outer blade. Herein, the hair raising parts have higher hair raising ability to raise the flat lying hair than that of conventional ones.

SUMMARY OF THE INVENTION

However, in the conventional technique, the plurality of bars are formed so that skin contact surfaces thereof are included in a same plane. It is therefore difficult for the hair raising parts provided for the bars to go under body hairs lying flat (between body hairs and the skin surface). Accordingly, the conventional technique does not provide a good performance of introducing flat lying body hair to the outer blade.

An object of the present invention is to provide an electric shaver with an improved performance of introducing flat lying body hair to the outer blade.

In order to achieve the aforementioned object, the present invention is an electric shaver including: an outer blade including blade holes defined by bars; an inner blade which is provided inside of the outer blade and moved relative to the outer blade to cut body hair inserted into the blade holes. In the electric shaver, the bars include a hair raising bar having a hair raising portion raising the body hair and a first bar having a skin contact surface positioned on the inner blade side of a skin contact surface of the hair raising bar, and the first bar is provided adjacent to and forward of the hair raising bar.

BRIEF DESCRIPTION OF THE DRAWINGS

FIGS. 12A and 123 show a longitudinal arrangement of the bars according to the first embodiment of the present invention, FIG. 12A being an enlarged plan view of a part of FIG. 11, FIG. 12B being a cross-sectional view taken along a line B-B.

DETAILED DESCRIPTION OF THE PREFERRED EMBODIMENTS

Figure 1:
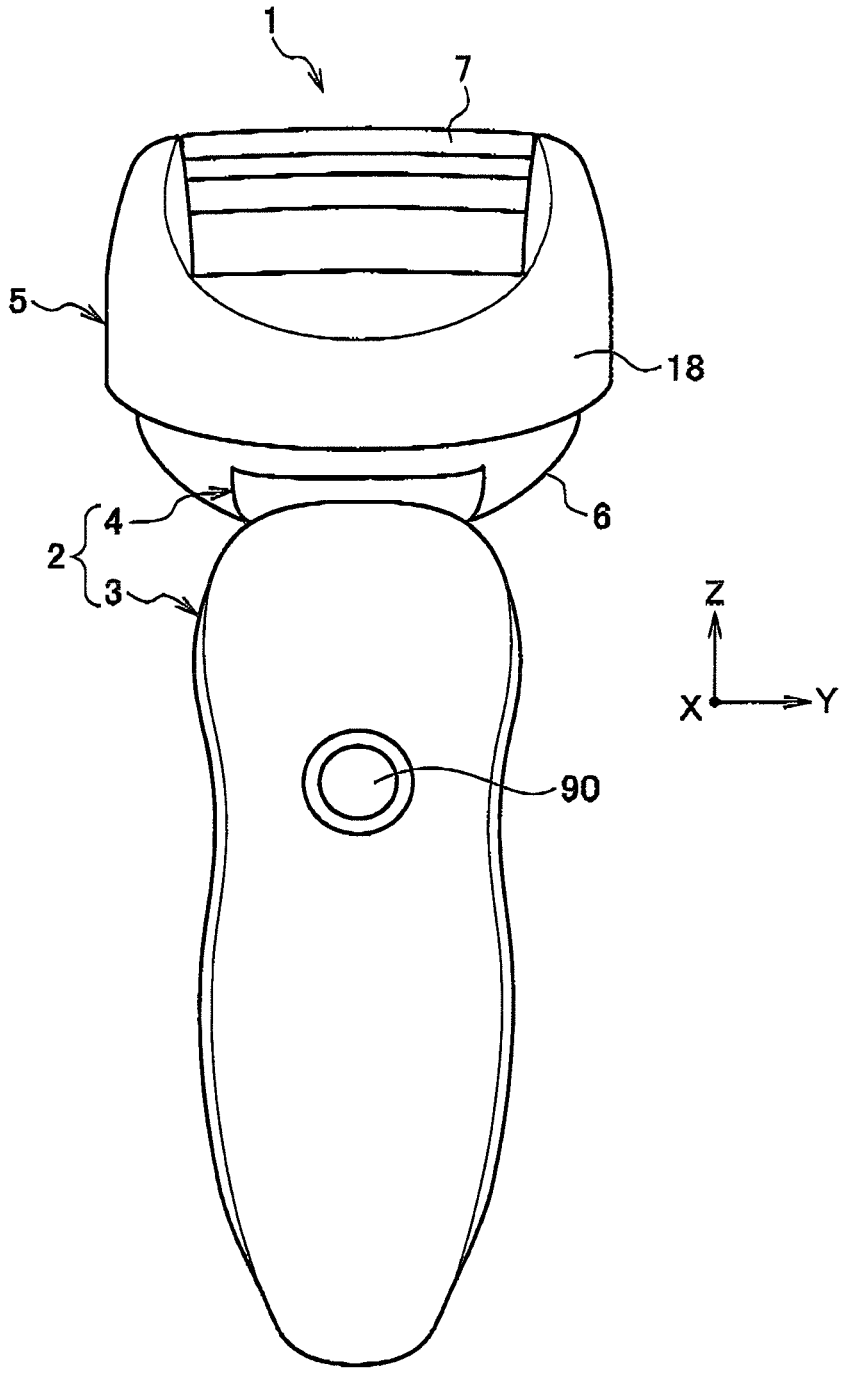
FIG. 1 is a front view showing an electric shaver according to a first embodiment of the present invention.

Hereinafter, embodiments of the present invention will be described in detail with reference to the drawings. Note that similar constituent elements are included in a plurality of the following embodiments. Hence, in the following, common reference numerals are assigned to these similar constituent elements, and a duplicate description is omitted. In the following description, the direction that a plurality of outer blades are arranged side by side is referred to as a front-back direction (a shaving direction) X, and the direction that each outer blade extends is referred to as a right-left direction Y. The vertical direction in a state where a head section is placed with the outer blade facing upward is referred to as a vertical direction Z.

First Embodiment

An electric shaver 1 according to this embodiment includes a grip section 2 gripped by a hand and a head section fixed to the grip section 2 as shown in FIG. 1.

The grip section 2 includes: a grip body 3 which is made of synthetic resin and incorporates a not-shown battery; and a grip joint portion 4 which is made of synthetic resin and is protruded rearward from the upper surface of the grip body 3. The head section 5 may be attached to the grip section 2 so as to swing in the right-left or front-back direction by providing at least one of a known right-left swinging mechanism and a known front-back swinging mechanism on the upper surface of the grip joint portion 4.

The head section 5 includes: a linear head portion 6 which incorporates a not-shown linear motor and is connected to the grip joint portion 4; and a blade unit 7 attached to the linear head portion 6. As shown in FIG. 1, at the grip body 3, a switch portion 90 configured to turn on and off drive of the linear motor is formed. The grip body 3 may be provided with a display portion displaying a charging state of the battery and the like.

The blade unit 7 includes outer blades 8 exposed upward in the head section 5 and inner blades 13 which are provided inside of the outer blades 8 (under the outer blades 8) and moved relative to the outer blades 8.

This embodiment is provided with four (a plurality of) outer blades: a first net blade 9, a finishing net blade 10, a slit blade 11, and a second net blade 12, which are arranged side by side in the front-back direction X.

Figure 4:
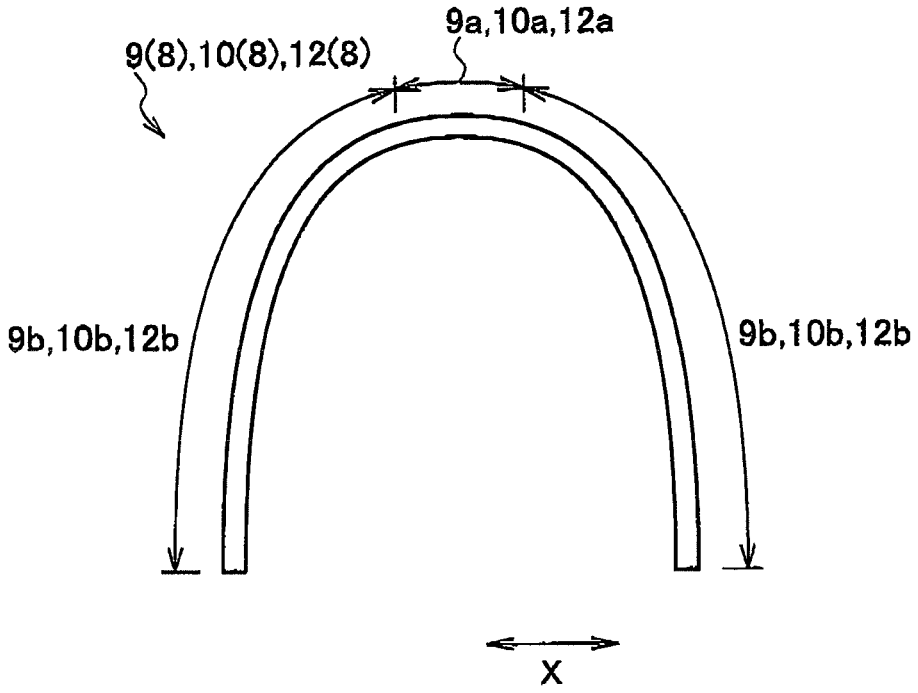
FIG. 4 is a schematic side view of the outer blade according to the first embodiment of the present invention.

As shown in FIG. 4, each of the net blades 9, 10, and 12 is curved in an inverted U shape in the front-back direction (the short side direction) so as to be convex up in a side view (when each outer blade is seen in the right-left direction Y). Furthermore, each of the net blades 9, 10, and 12 is slightly curved in the right-left direction (the longitudinal direction) Y so as to be convex up in a front view (when each outer blade is seen in the front-back direction X). In this embodiment, the net blades 9, 10, and 12 are curved so as to be convex up in the front view but are not necessarily curved.

Figure 3:
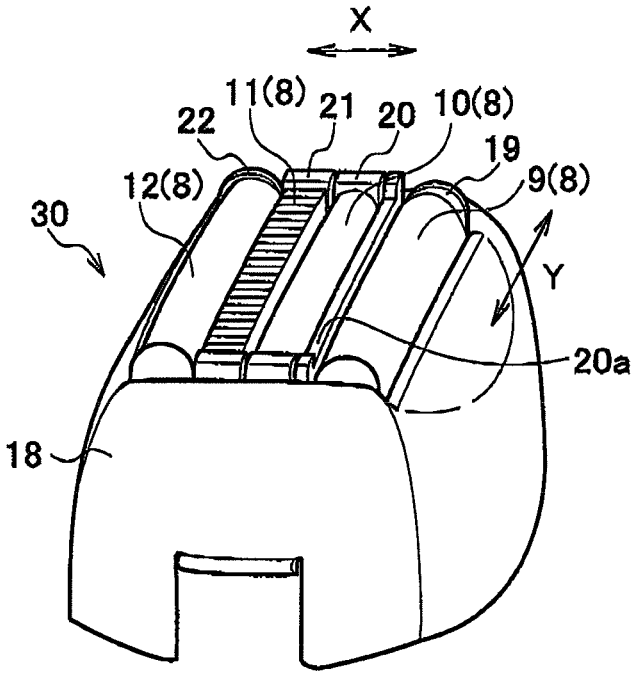
FIG. 3 is a perspective view schematically showing an outer blade cassette according to the first embodiment of the present invention.

In the net blades 9, 10, and 12, a number of blade holes 50 are defined by bars 40. Furthermore, as shown in FIG. 3, in this embodiment, the blade width of the finishing net blade 10 (width in the front-back direction X) is set smaller than blade widths of the first and second net blades 9 and 12 (widths in the front-back direction X). By setting the blade width of the finishing net blade 10 smaller than the blade widths of the other net blades 9 and 12, in other words, by setting the curvature radius of the finishing net blade 10 small, skin 70 pressed against the surface is greatly protruded inside through the blade holes 50 so that body hair 71 (see FIG. 14) can be cut short.

The slit blade 11 is curved in a squared U-shape in the front-back direction (the short-side direction) and includes a number of slits (blade holes) drilled from the flat upper wall to the side walls.

To be specific, in the slit blade 11, the number of slits (blade holes) are defined by substantially squared U-shaped bars from the flat upper wall to the side walls and a bar extending along the longitudinal direction (the right-left direction) Y at the bottom of each side wall.

The net blades 9, 10, and 12 and the slit blade 11 constituting the outer blades 8 are attached to dedicated outer blade frames 19, 20, 22, and 21, respectively.

Furthermore, a skin guard member 20*a* is formed in the first net blade 9 side of the outer blade frame 20. The skin guard member 20*a* and the slit blade 11 sandwiching the finishing net blade 10 at the front and rear sides effectively prevent the skin 70 from being strongly pressed against the finishing net blade 10 having a small curvature.

The outer blade frame 19 to which the first net blade 9 is attached, the outer blade frame 20 to which the finishing net blade 10 is attached, the outer blade frame 21 to which the slit blade 11 is attached, and the outer blade frame 22 to which the second net blade 12 is attached are individually engaged with an outer blade frame 18 to form the outer blade cassette 30. The outer blade cassette 30 is attached to the linear head portion 6.

Figure 2:
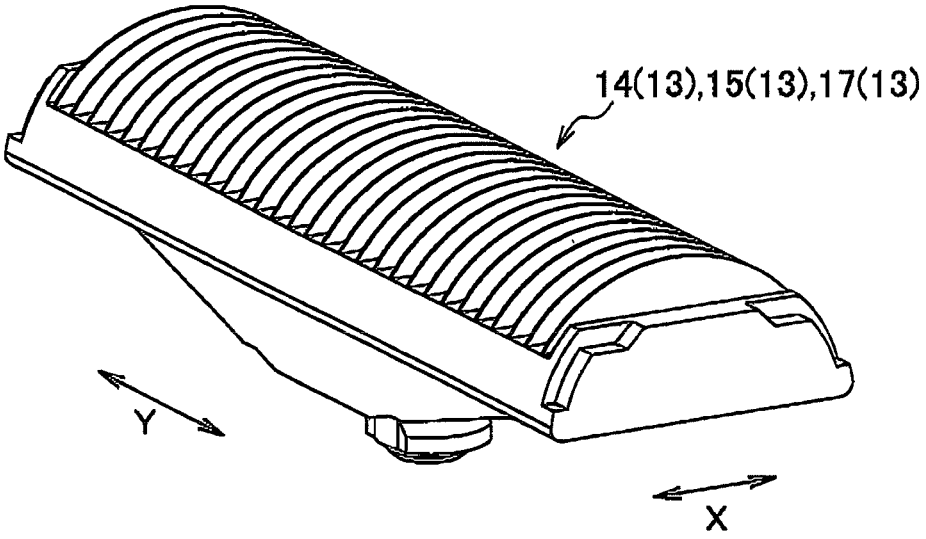
FIG. 2 is a perspective view showing an inner blade according to the first embodiment of the present invention.

The inner blades 13 are dedicatedly provided for the net blades 9, 10, and 12 and the slit blade 11 constituting the outer blades 8. Specifically, under (inside) the net blades 9, 10, and 12, inversed U-shape inner blades 14, 15, and 17 along the curves of the corresponding net blades 9, 10, and 12 are provided, respectively (see FIG. 2). Under (inside) the slit blade 11, a squared U-shaped slit inner blade (not-shown) along the curve of the slit blade 11 is provided.

The inner blades 14, 15, and 17 and slit inner blade (not shown) are attached to the aforementioned not-shown linear motor. If the linear motor is driven, the inner blades 14, 15, and 17 and the slit inner blade (not shown) are reciprocated in the right-left direction (longitudinal direction) Y.

By moving the inner blades 14, 15, 17 and slit inner blade (not shown) provided under (inside) the net blades 9, 10, and 12 and slit blade 11 relative to the net blades 9, 10, and 12 and slit blade 11, respectively, the body hair 71 inserted in the blade holes 50 of the net blades 9, 10, and 12 and the slits of the slit blade 11 are cut by the net blades 9, 10, and 12 and slit blade 11 in cooperation with the inner blades 14, 15, and 17 and slit inner blade (not shown).

Next, the net blades 9, 10, and 12 according to this embodiment will be described in detail.

Figure 5:
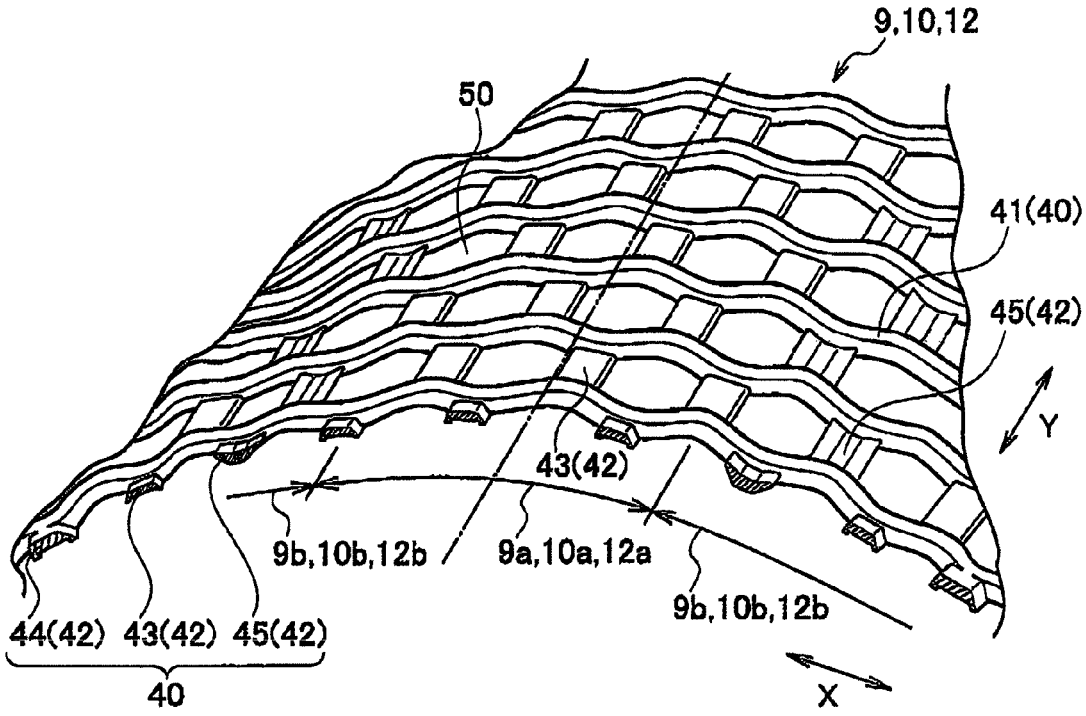
FIG. 5 is an enlarged perspective view of a part of the outer blade according to the first embodiment of the present invention.

In this embodiment, in the net blades 9, 10, and 12, a number of the blade holes 50 are defined by the bars 40. Specifically, as shown in FIG. 5, the bars 40 include: short-side bars 41 extending in a wave shape in the short-side direction (front-back direction) X; and longitudinal bars 42 extending in the longitudinal direction (right-left direction) Y. These short-side and longitudinal bars 41 and 42 define the blade holes 50 substantially hexagonal in a plan view. These blade holes 50 have sufficient size to allow the body hairs 71 to be inserted therein.

Figure 11:
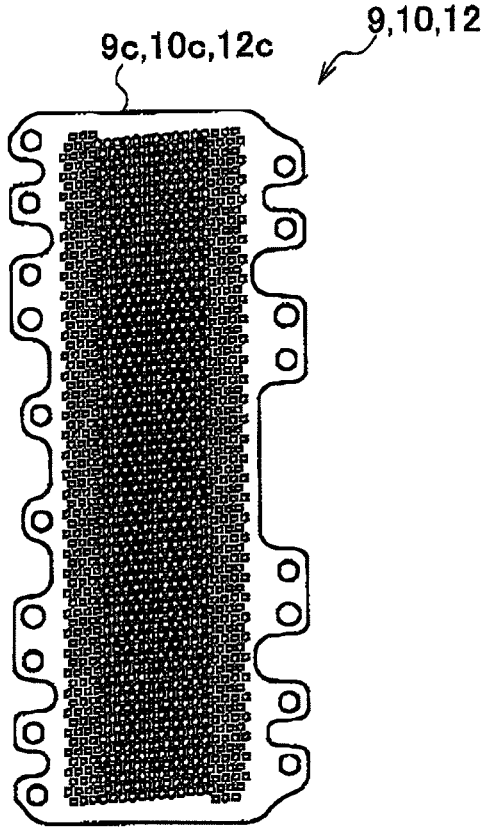
FIG. 11 is a plan view of a long plate member according to the first embodiment of the present invention.
Figure 12A:
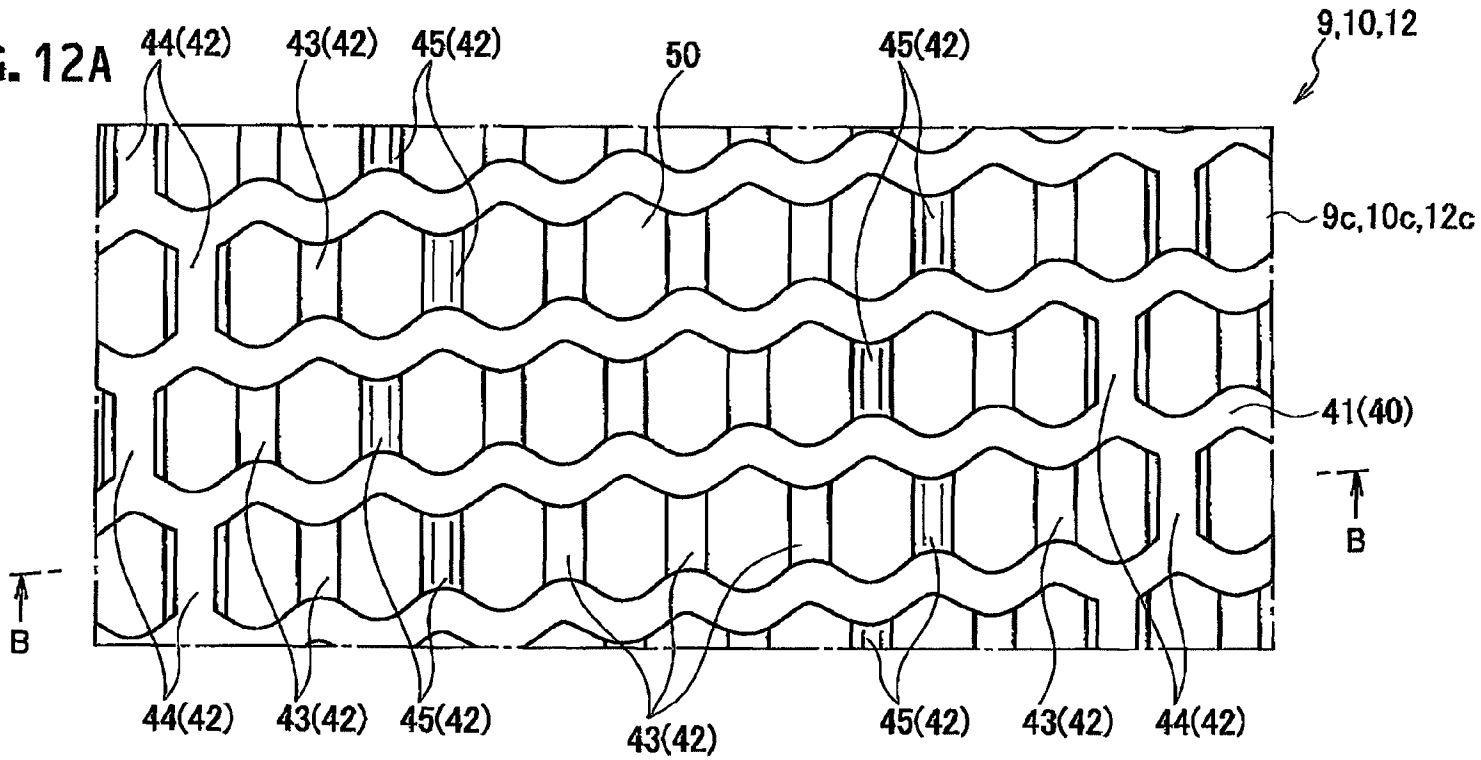
Figure 12B:
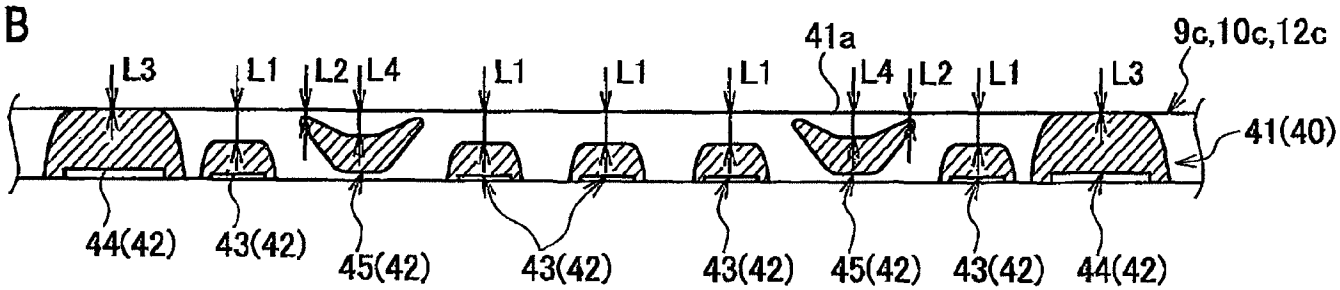

In this embodiment, long-plate members 9*c*, 10*c*, and 12*c* (see FIG. 11) including the number of blade holes 50 are curved in an inverted U-shape along the front-back direction (shaving direction) X so as to be convex up and attached to the outer blade frames 19, 20, and 22 to form the net blades 9, 10, and 12 curved in an inverted U-shape in a side view, respectively.

In the net blades 9, 10, and 12 curved in the inverted U-shape in a side view, top sections 9*a*, 10*a*, and 12*a* positioned at the top have large contact pressure against the skin 70. The outside sections 9*b*, 10*b*, and 12*b* positioned on both sides of the top sections 9*a*, 10*a*, and 12*a* in the short-side direction have small contact pressure against the skin 70. The dashed-dotted line in FIG. 5 indicates a centerline passing through the center of each of the top sections 9*a*, 10*a*, and 12*a* in the short-side direction.

Figure 6:
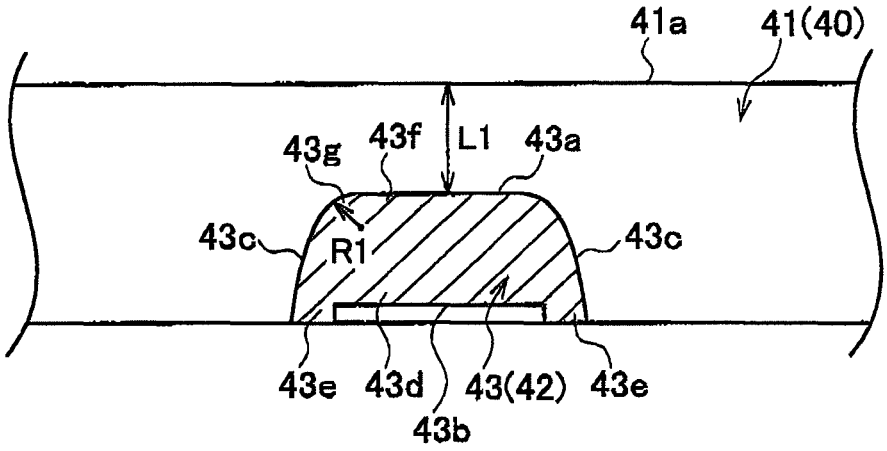
FIG. 6 is a cross-sectional view of one of first bars according to the first embodiment of the present invention.
Figure 7:
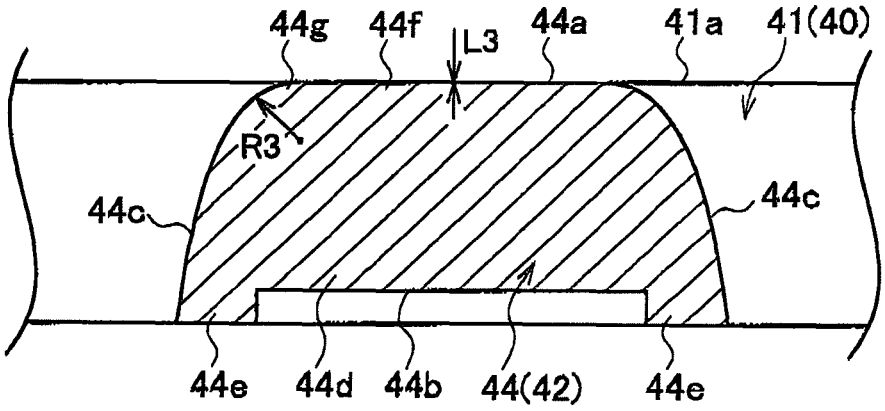
FIG. 7 is a cross-sectional view of one of second bars according to the first embodiment of the present invention.
Figure 8A:
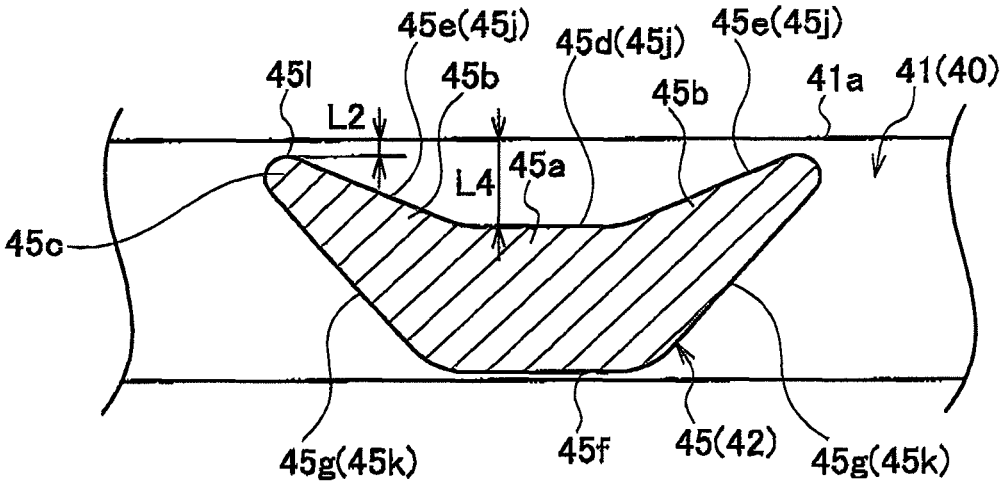
FIGS. 8A and 8B show cross-sectional views of one of hair raising bars according to the first embodiment of the present invention, FIG. 8A being a cross sectional view of the hair raising bar, FIG. 8B being an enlarged cross-sectional view of a hair raising portion.

In this embodiment, the longitudinal bars 42 include: longitudinal bars (first bars) 43 each having a cross-sectional shape shown in FIG. 6; longitudinal bars (second bars) 44 each having a cross-sectional shape shown in FIG. 7; and longitudinal bars (hair raising bars) 45 each having a cross-sectional shape shown in FIG. 8A.

As shown in FIG. 6, each of the longitudinal bars (first bar) 43 includes a substantially flat top surface (skin contact surface) 43*a*, a flat bottom surface 43*b* formed on the inner blade 13 side (the bottom in FIG. 6), both side surfaces 43*c* and 43*c* smoothly connecting the ends of the top surface (skin contact surface) 43*a* and the bottom surface 43 in the short-side direction and is formed so as to have a substantially half-barrel shape in a cross section. At the both ends of a bottom portion 43*d* of the longitudinal bar 43 in the short-side direction, sliding portions 43*e*, 43*e* are protruded toward the inner blade 13 side. The sliding portions 43*e*, 43*e* are configured to slide on the inner blades 13 so that the body hair 71 is cut by the sliding portions 43*e* and the inner blade 13. In this embodiment, an end 43*g* of an upper portion 43*f* of the longitudinal bar (first bar) 43 in the short-side direction is formed to have a semicircular cross section with a curvature radius R1 so as to reduce damage of the skin 70. The curvature radius R1 is preferably 10 μm, for example.

Moreover, as shown in FIG. 7, each longitudinal bar (second bar) 44 includes: a substantially flat top surface (skin contact surface) 44*a* which is formed on the skin 70 side (in the upper side of FIG. 7) and comes into contact with the skin 70; a flat bottom surface 44*b* formed on the inner blade 13 side (in the lower side in FIG. 7); and both side surfaces 43*c* and 43*c* smoothly connecting the ends of the top surface (skin contact surface) 44*a* and the bottom surface 44*b* in the short-side direction. The top and bottom surface and the side surfaces form a substantially half-barrel shape in a cross section. At the both ends of a bottom portion 44*d* of the longitudinal bar (second bar) 44 in the short-side direction, sliding portions 44*e*, 44*e* are protruded toward the inner blades 13 side and are configured to slide on the inner blades 13 so that the body hair 71 are cut by the sliding portions 44*e* and the inner blades 13. In this embodiment, an end 44*g* of an upper portion 44*f* of the longitudinal bar (second bar) 44 in the short-side direction is formed so as to have a semicircular cross section with a curvature radius R3 so as to reduce damage of the skin 70. The curvature radius R3 is preferably set to 10 μm or more, for example.

Herein, the top surface (skin contact surface) 41*a* of each short-side bar 41 is closer to the skin 70 than the top surface 43*a* of each longitudinal bar (first bar) 43. The vertical distance between the top surface 43*a* of each longitudinal bar (first bar) 43 and the top surface 41*a* of each short-side bar 41 is set to L1. The top surface 41*a* of the short-side bar 41 and the top surface 44*a* of the longitudinal bar (second bar) 44 form a substantially same plane. Vertical distance L3 between the top surface 41*a* of each short-side bar 41 and the top surface 44*a* of each longitudinal bar (second bar) 44 is substantially zero.

As shown in FIG. 8A, each of the longitudinal bars (hair raising bars) 45 is formed so as to have a substantially V-shaped cross section. Specifically, a plate portion 45*a* having a substantially plate shape is formed at the center in the short-side direction. At the both ends of the plate portion 45*a* in the short-side direction, inclined portions 45*b* are provided. The inclined portions 45*b* are inclined so as to go upward from the plate portion 45*a* toward the both ends in the short-side direction. The inclined portions 45*b* are tapered so as to narrow from the plate portion 45*a* toward the both ends in the short-side direction. At the ends 45*l* of the inclined portions 45*b* in the short-side direction, hair raising portions 45*c* to raise the body hair 71 are formed. The hair raising portions 45*c* have a hair raising operation to more effectively raise the body hair 71 having small angle from the skin surface (flat lying body hair). In this embodiment, each longitudinal bar (hair raising bar) 45 includes: the hair raising portion 45*c* (on the right side of FIG. 14) exerting the hair raising operation mainly when the electric shaver is moved one way in the shaving direction (from the left to the right in FIG. 14; the direction a); and the hair raising portion 45*c* (on the left side of FIG. 14) exerting the hair raising operation mainly when the electric shaver is moved in the other way in the shaving direction (from the right to the left in FIG. 14; the direction b). In short, the plurality of hair raising portions are provided for each hair raising bar facing in different directions so as to exert the hair raising operation when the electric shaver moves at least in two directions.

In this embodiment, the side surfaces 43*c* of the longitudinal direction bar (first bar) 43 and the side surfaces 44*c* of the longitudinal bar (second bar) 44 also function as hair raising portions to raise the body hair 71. Although the side surfaces 43*c* and 44*c* also include the hair raising operation to raise the body hair 71 having small angle from the skin surface, the hair raising portions 45*c* can more effectively raise the body hair 71 lying flat than the side surfaces 43*c* and 44*c*. In other words, the hair raising portions 45*c* have higher hair raising ability to raise the body hair 71 lying flat than that of the side surfaces 43*c* and 44*c*.

As described above, in this embodiment, each longitudinal bar (the hair raising bar) 45 is provided with the hair raising portions 45*c* with higher hair raising ability than those of the hair raising portions (the side surfaces 43*c* in this embodiment) of the longitudinal bars (the first bars) 43 and the hair raising portions (the side surfaces 44*c* in this embodiment) of the longitudinal bars (the second bars) 44.

Moreover, each longitudinal bar (hair raising bar) 45 is defined by the upper flat surface 45*c* of the plate portion 45*a*, upper inclined surfaces 45*e* of the inclined portions 45*c*, the bottom surface 45*f* of the plate portion 45*a*, and the lower inclined surfaces 45*g* of the inclined portions 45*c*.

In this embodiment, the upper flat surface 45*d* and the upper inclined surfaces 45*e* correspond to a skin contact surface 45*j* coming into the skin 70, and the lower inclined surfaces 45*g* correspond to hair introducing surfaces 45*k* which introduce the body hair 71 inside the outer blades (toward the inner blades).

The vertical distance between the ends 45*l* of each hair raising portion 45*c* and the top surface 41*a* of each short-side bar 41 is set to L2. The raising portions 45*c* are arranged with an offset so as to satisfy a relation of L3<L2<L1.

The vertical distance between the upper flat portion 45*d* of each longitudinal bar (hair raising portion) 45 and the top surface 41*a* of each short-side bar 41 is set to L4. The upper flat portion 45*d* is arranged with an offset so as to satisfy a relation of L3<L4<L1.

Figure 8B:
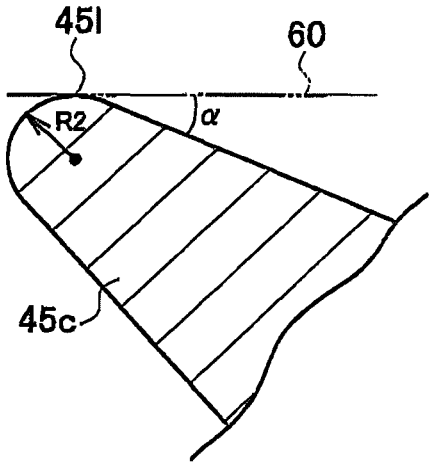
Figure 9:
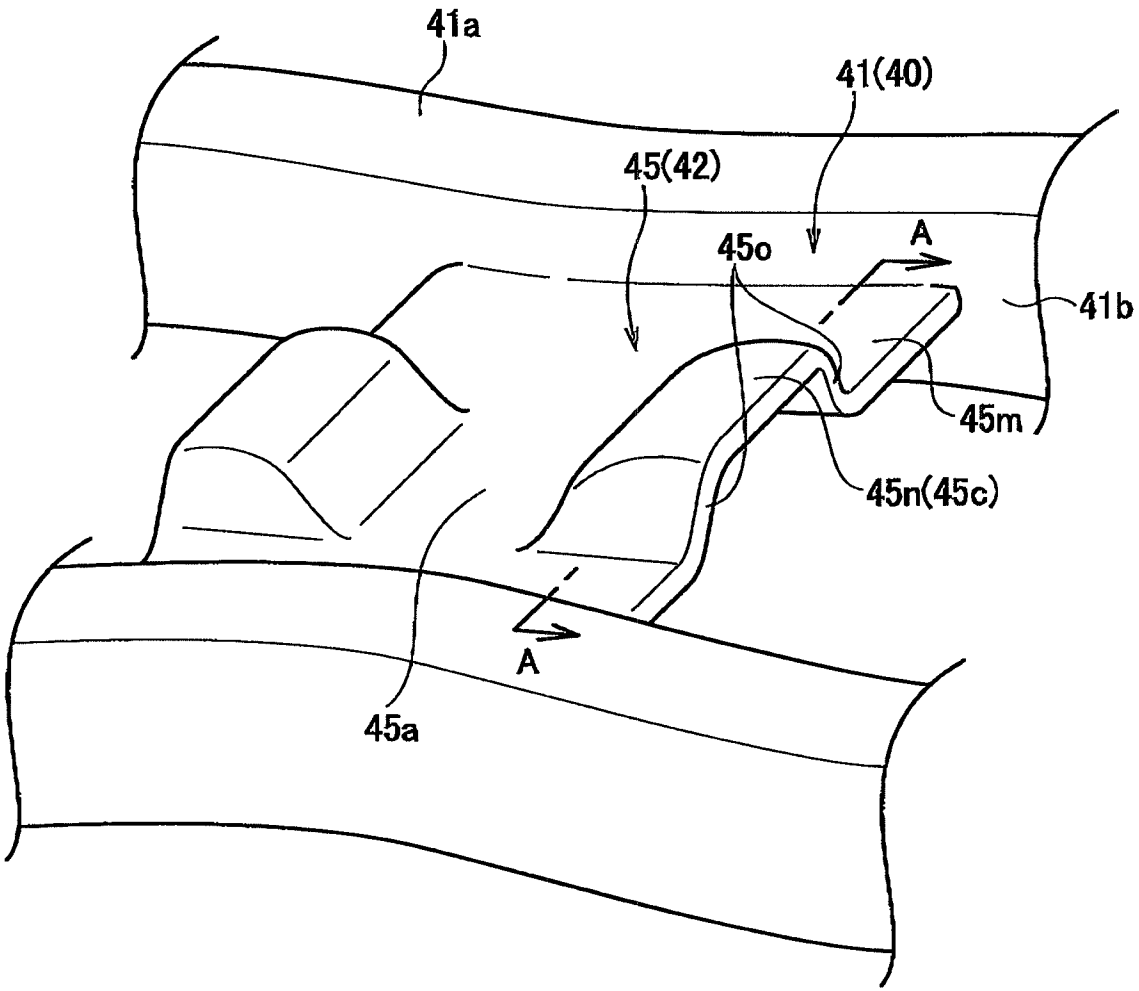
FIG. 9 is a perspective view showing the hair raising bar according to the first embodiment of the present invention.
Figure 10:
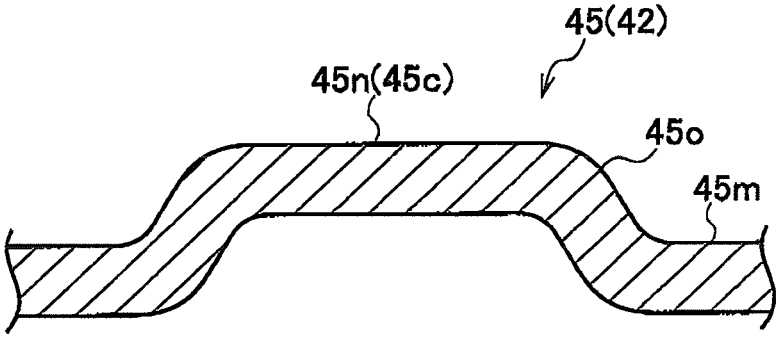
FIG. 10 is a cross-sectional view taken along a line A-A of FIG. 9.

As shown in FIG. 8B, each of the ends 45*l* of the inclined portions 45*b* in the short-side direction is formed so as to have a semicircular cross-section with a curvature radius R2. Herein, the relation of the curvature radii R1 to R3 are set to R2<R1≤R3. Preferably, R2 is 3 μm, for example. Herein, a clearance angle α between a reference line 60 in the short-side direction (herein after, referred to as a short-side direction reference line 60) indicated by a two-dot chain line and each upper inclined surface 45*e* is set larger than a clearance angle (0°) between the top surface 43*a* of each longitudinal bar (first bar) 43 and the short-side direction reference line 60 and a clearance angle (0°) between the top surface 44*a* of each longitudinal bar (second bar) 44 and the short-side direction reference line 60. By setting the clearance angle in the part with high contact pressure against the skin 70 smaller than the clearance angle in the part with low contact pressure against the skin 70 as described above, it is possible to reduce the influence (damage) of the part with high contact pressure against the skin 70 on the skin 70.

Furthermore, in this embodiment, each longitudinal end 45*m* of each longitudinal bar (hair raising bar) 45 extends from the side wall surface 41*b* of the short-side bar 41 in the longitudinal direction so as to have a linear cross-section and is gradually curved through a boundary portion 45*o* to be connected to a longitudinal center portion 45*n*. Preferably, the boundary portion 45*o* has a curvature radius of 10 μm, for example.

As described above, in this embodiment, the longitudinal bars 42 (bar 40) include: the longitudinal bars (hair raising bars) 45 each including the hair raising portions 45*c* with higher hair raising ability than those of the hair raising portions (corresponding to the side surfaces 43*c* and 44*c* in this embodiment) of the other bars (longitudinal bars 43 and 44); the longitudinal bars (first bars) 43, in each of which the top surface 44*a* is positioned on the inner blade 13 side of the skin contact surface 45*j* of each longitudinal bar (hair raising hair) 45; and the longitudinal bars (second bars) 44, in each of which the top surface 43*a* is positioned on the skin 70 side of the skin contact surface 45*j* of each longitudinal bar (hair raising hair) 45.

Herein, in this embodiment, the longitudinal bars (first bars) 43 are placed in the part of each of the net blades 9, 10, and 12 with high contact pressure against the skin 70 (the top sections 9*a*, 10*a*, and 12*a*), and the longitudinal bars (hair raising bars) 45 are placed in the part with low contact pressure (the outside sections 9*b*, 10*b*, and 12*b*).

Furthermore, one of the longitudinal bar (first bar) 43, in which the top surface (skin contact surface) 43*a* coming into contact with the skin 70 is positioned on the inner blade 13 side of the skin contact surface 45*j* of the longitudinal bar (hair raising bar) 45, is provided in adjacent to each longitudinal bar (hair raising bar) 45 forwardly in the short-side direction (the front-back direction; the shaving direction) X.

Specifically, the longitudinal bars 45 are provided at ends of the outside sections 9*b*, 10*b*, and 12*b* on the top section sides. Herein, the outside sections 9*b*, 10*b*, and 12*b* extend on both sides of the top sections 9*a*, 10*a*, and 12*b* in the short-side direction X, respectively.

Figure 13:
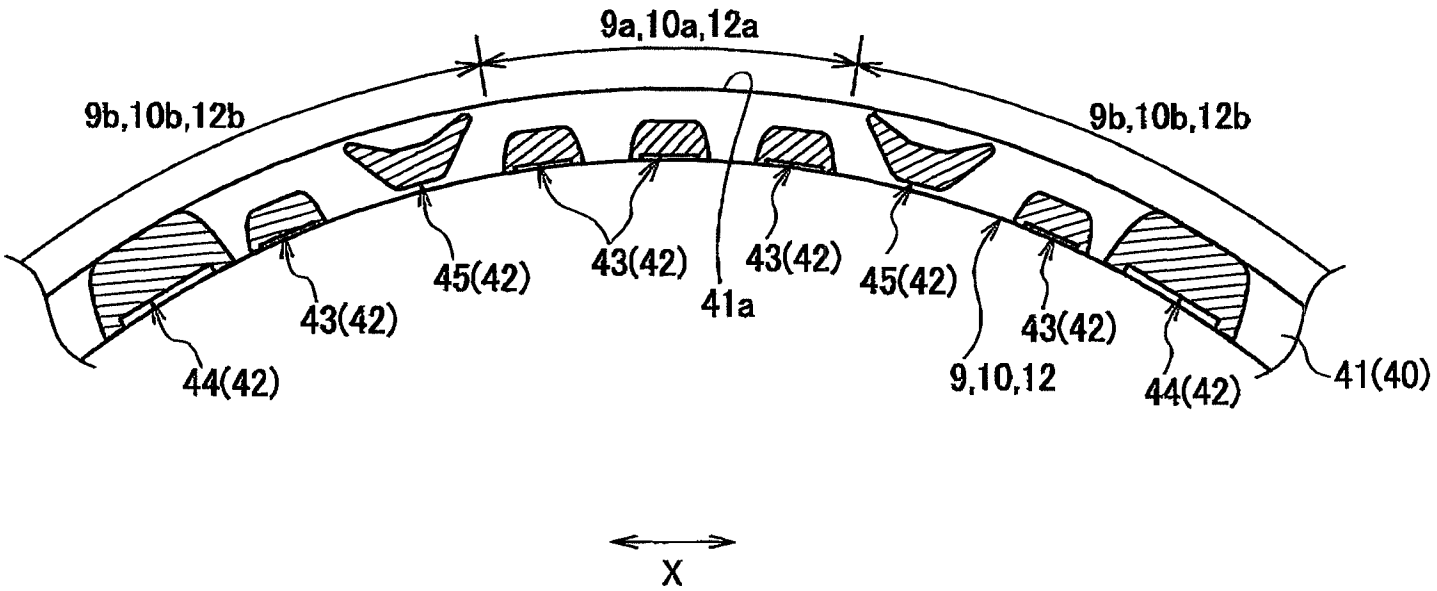
FIG. 13 is an enlarged cross-sectional view showing the longitudinal arrangement of the bars according to the first embodiment of the present invention.

Some of the longitudinal bars (first bars) 43 are provided adjacent to the respective longitudinal bars (hair raising bars) 45 outside thereof in the short-side direction X (on the lower side FIG. 13).

In this embodiment, furthermore, some of the longitudinal bars (second bars) 44, in each of which the top surface (skin contact surface) 44*a* coming into contact with the skin 70 is positioned on the skin 70 side of the skin contact surface 45*j* of the longitudinal bars (body hair bars) 45, are individually provided outside thereof in the short-side direction (on the lower side of FIG. 13), the longitudinal bars 43 being provided adjacent to the longitudinal bars (body hair bars) 45.

In this embodiment, in short, the longitudinal bar (body hair bars) 45, longitudinal bar (first bar) 43, and longitudinal bar (second bar) 44 are provided, 10*b*, and 12*b* in this order starting from the top section side as shown in FIG. 13.

In this embodiment, one of the longitudinal bars (first bars) 43 is provided on the rear side of each longitudinal bar (hair raising bar) 45 in the shaving direction. In other words, the longitudinal bars (first bars) 43 are placed on both sides of each longitudinal bar (hair raising bar) 45 in the short-side direction.

Since the longitudinal bars (first bars) 43 are placed on both sides of each longitudinal bar (body hair bar) 45 in the short-side direction as described above, the longitudinal bars (first bars) 43 exist forward of the longitudinal bar (body hair bar) 45 in the shaving direction whichever the outer blades 8 are moved in the short-side direction forward or backward.

Figure 14A:
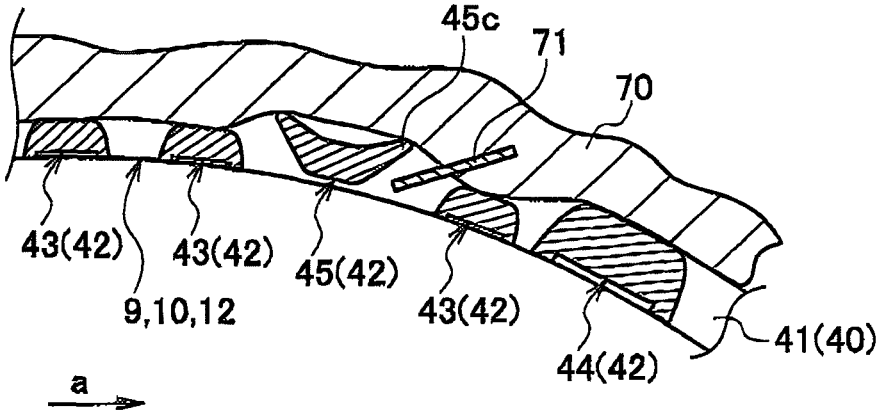
FIGS. 14A and 14B schematically illustrate a process where one of the hair raising bars according to the first embodiment of the present invention is raising a flat lying body hair, FIG. 14A being a cross-sectional view schematically showing a state where the hair raising portion of the hair raising bar is under the flat lying body hair, FIG. 14B being a cross-sectional view schematically showing a state where the hair raising portion is raising the flat lying body hair.
Figure 14B:
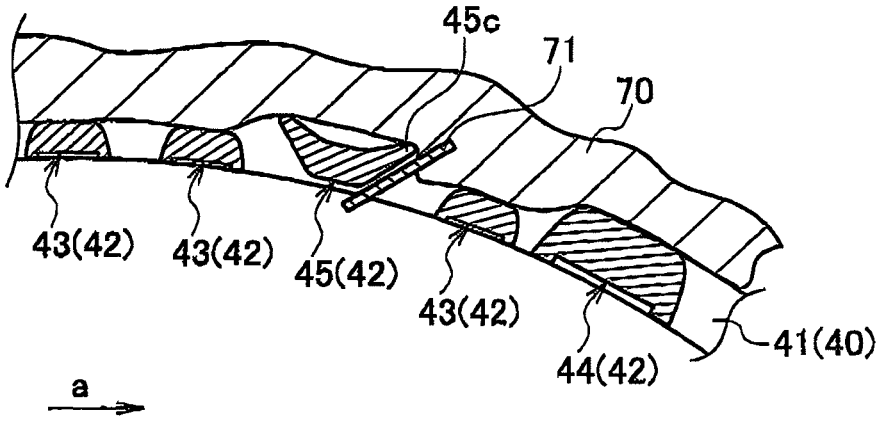

As described above, in this embodiment, the longitudinal bars (first bars) 43, in each of which the top surface (skin contact surface) coming into contact with the skin 70 is positioned on the inner blade 13 side of the skin contact surface 45*j* of the longitudinal bar (body hair bar) 45, is provided in adjacent to and forward of each longitudinal bar (body hair bar) 45 in the short-side direction (the front-back direction; the shaving direction). Accordingly, there is a large space ahead of the hair raising portion 45*c*, so that the skin 70 can be further introduced to the inner blade side 13. When the electric shaver 1 is in use, the hair raising portions 45*c* can be further pressed into the skin 70, so that the flat lying body hair 71 can be more efficiently raised (see FIG. 14). According to this embodiment, it is possible to increase the performance of introducing the flat lying body hair 71 into the net blades (outer blades) 9, 10, and 12. Moreover, FIG. 14 shows an example where the net blades (outer blades) 9, 10, and 12 move one way in the shaving direction (from the left to the right in FIG. 14; the direction a). However, it is possible to provide the same operations and effects when the net blades (outer blades) 9, 10, and 12 move the other way in the shaving direction (from the right to the left in FIG. 14; the direction b). In this case, the front and back in the shaving direction are replaced with each other.

In this embodiment, one of the longitudinal bars (first bars) 43 is also placed behind each longitudinal bar (hair raising bar) 45 in the shaving direction. In other words, the longitudinal bars (first bars) 43 are placed on both sides of each longitudinal bar (body hair bar) 45. When the electric shaver 1 is in use, the hair raising portions 45*c* can be further pressed into the skin 70, so that the flat lying body hair 71 can be more efficiently raised.

Moreover, in this embodiment, the bars 40 include the longitudinal bars (second bars) 44, in each of which the top surface (skin contact surface) 44*a* coming into contact with the skin 70 is positioned on the skin 70 side of the skin contact surface 45*j* of each longitudinal bar (hair raising bar) 45. By providing the longitudinal bars (second bars) 44 in such a manner, the hair raising portions 45*c* can be prevented from being excessively pressed into the skin 70, thus reducing the influence (damage) on the skin 70 (see FIG. 14).

In this embodiment, in each short-side bar 41, the top surface (skin contact surface) 41*a* coming into contact with the skin 70 is positioned on the skin 70 side of the skin contact surface 45*j* of each longitudinal bar (hair raising bar) 45. Each short-side bar 41 therefore corresponds to a second hair raising bar. Accordingly, the longitudinal bars (second bars) 44 and the short-side bars 41 can effectively reduce the influence (damage) on the skin 70.

By providing the longitudinal bars (hair raising bars) 45, the longitudinal bars (first bars) 43, and the longitudinal bars (second bars) 44 are provided for the net blades (outer blades) 9, 10, and 12, the influence (damage) on the skin 70 is reduced while the performance of introducing the flat lying body hair 71 to the net blades (outer blades) 9, 10, and 12 can be increased.

According to this embodiment, in the part of each of the net blades 9, 10, and 12 with high contact pressure against the skin 70 (the top sections 9*a*, 10*a*, and 12*a*), the longitudinal bars (first bars) 43 are placed. In the part with high contact pressure against the skin 70 (the outside sections 9*b*, 10*b*, and 12*b*), the longitudinal bars (hair raising bars) 45 each including the hair raising portions 45*c* with higher hair raising ability than that of the side surfaces (hair raising portions) 43*c* of the longitudinal bars (first bars) 43 are placed.

By setting the hair raising ability of the part with high contact pressure against the skin 70 lower than that of the part with low contact pressure, it is possible to reduce the influence of the part with high contact pressure against the skin 70 on the skin 70.

Since the part with low contact pressure against the skin 70 originally have less influence on the skin 70, the hair raising ability is increased so as to efficiently raise hair.

According to this embodiment, the bars 40 include the longitudinal bars 42 extending in the longitudinal direction of the net blades (outer blades) 9, 10, and 12 and the short-side bars 41 extending in the short-side direction intersecting the longitudinal direction, thus forming the net blades (outer blades) 9, 10, and 12 into mesh. This allows the body hair 71 to be easily inserted into the blade holes 50, thus providing an effect of facilitating shaving the body hair 71.

According to this embodiment, each of the net blades (outer blades) 9, 10, and 12 is curved in an inverted U-shape in a side view. The side surfaces (hair raising portions) 43*c* are formed at both ends of the longitudinal bars 43 in the short-side direction in the net blades (outer blades) 9, 10, and 12. The side surfaces (hair raising portions) 44*c* are formed at both ends of the longitudinal bars 44 in the short-side direction in the net blades (outer blades) 9, 10, and 12. The hair raising portions 45*c* are formed at both ends of the longitudinal bars 45 in the short-side direction in the net blades (outer blades) 9, 10, and 12. The body hairs 71 can be therefore raised whichever the electric shaver 1 is moved in the short-side direction forward or backward. This can provide an effect of improving the usability.

According to this embodiment, the inclined portions 45*b* inclined so as to go up from the plate portion 45*a* toward the both ends thereof in the short-side direction are provided for each longitudinal bar (hair raising bar) 45. Moreover, the inclined portions 45*b* are tapered so as to narrow from the plate portion 45*a* toward the both ends in the short-side direction. At the ends 45*l* of each inclined portion 45*b* in the short-side direction, the hair raising portions 45*c* configured to raise the body hair 71 are formed. By forming each short-side end 45*l* having a tapered cross section to constitute the hair raising portion 45*c* in such a manner, the hair raising portions 45*c* can be formed in a simple shape. Moreover, it is possible to prevent the body hair 71 with small hair angle (the angle between the direction that the body hair extends and the skin surface) to go into between the hair raising portion 45*c* and the skin 70, thus reliably raising the flat lying body hairs 71.

According to this embodiment, moreover, the longitudinal end 45*m* of each longitudinal bar 45 is formed so as to have a substantially liner cross-section, and the inclined portions 45*b* are provided for the longitudinal center portion 45*n*. These longitudinal end 45*m* and the longitudinal center portion 45*n* are connected by the gradually curved boundary portion 45*o* between the longitudinal edge 45*m*, and the longitudinal center portion 45*n*. By connecting the longitudinal edge 45*m* and the longitudinal center portion 45*n* through the gradually curved boundary portion 45*o*, it is possible to reduce the influence (damage) on the boundary portion 450 on the skin 70 when the net blades (outer blades) 9, 10, and 11 are moved along the skin 70.

Next, modifications of the bars according to this embodiment will be described.

(First Modification)

Figure 15:
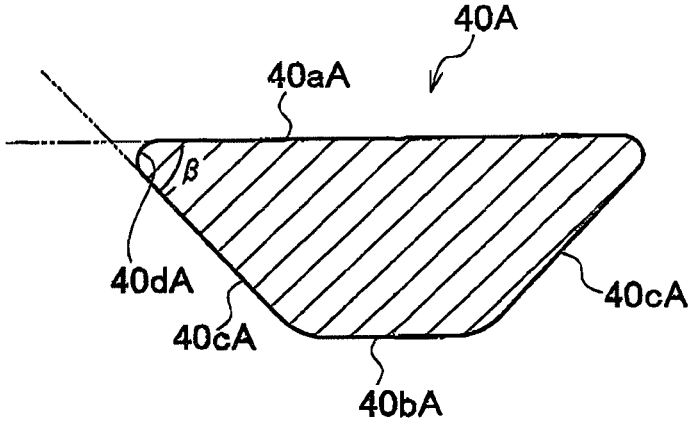
FIG. 15 is a cross sectional view of a bar according to a first modification of the first embodiment of the present invention.

As shown in FIG. 15, a bar 40A according to this modification has a substantially inverted trapezoidal cross-section and is formed by: a substantially flat top surface (skin contact surface) 40*a*A which is formed on the skin 70 side (on the upper side in FIG. 15) and comes into contact with the skin 70; a flat bottom surface 40*b*A formed on the inner blade 13 side (on the lower side in FIG. 15); and both side surfaces 40*c*A and 40*c*A smoothly connecting ends of the top surface (skin contact surface) 40*a*A and bottom surface 40*b*A in the short-side direction. Moreover, a pair of hair raising portions 40*d*A and 40*d*A are formed at both ends of upper part of the bar 40A in the short-side direction.

In order to use the aforementioned bar 40A as each of the first, second, and hair raising bars, the top surface (skin contact surface) 40*a*A of the first bar needs to be positioned on the inner blade 13 side of the top surface 40*a*A of the hair raising bar, and the top surface (skin contact surface) 40*a*A of the second bar needs to be positioned on the skin 70 side of the top surface 40*a*A of the hair raising bar. Furthermore, a taper angle β between the top surface (skin contact surface) 40*a*A of the hair raising bar and each side surface 40*c*A needs to be smaller than the taper angle β between the top surface (skin contact surface) 40*a*A and each side surface 40*c*A in the first bar and the taper angle β between the top surface (skin contact surface) 40*a*A and the side surface 40*c*A in the second bar. By setting the taper angle β of the hair raising portion of the hair raising bar smaller than those of the hair raising portions of the first and second bars, the hair raising ability of the hair raising portion of the hair raising bar can be set higher than those of the hair raising portions of the first and second bars. Preferably, the taper angles β of the hair raising portions of the first and second bars is 70°, for example, and the taper angles β of the hair raising portion of the hair raising bar is 20°, for example.

(Second Modification)

Figure 16:
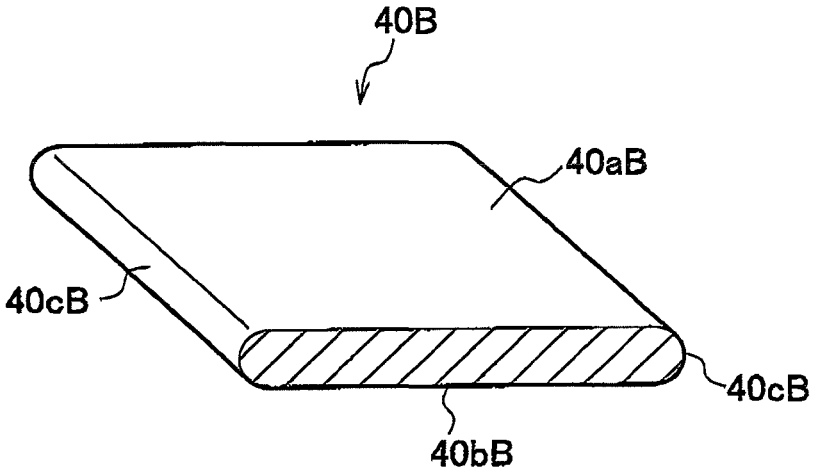
FIG. 16 is a cross sectional view of a bar according to a second modification of the first embodiment of the present invention.

As shown in FIG. 16, a bar 40B according to this modification is formed into a plate shape including: a substantially flat top surface (skin contact surface) 40*a*3 which is formed on the skin 70 side (on the upper side in FIG. 16) and comes into contact with the skin 70 and a flat bottom surface 40*b*B formed on the inner blade 13 side (on the lower side in FIG. 16). The both ends of the bar 40B in the short-side direction constitute semicircular hair raising portions 40*c*B and 400B.

In order to use the aforementioned bar 40B as each of the first, second, and hair raising bars, the top surface (skin contact surface) 40*a*B of the first bar needs to be positioned on the inner blade 13 side of the top surface 40*a*B of the hair raising bar, and the top surface (skin contact surface) 40*a*B of the second bar needs to be positioned on the skin 70 side of the top surface (skin contact surface) 40*a*B of the hair raising bar. Furthermore, the curvature radius of each hair raising portion

40$c$B of the hair raising bar needs to be smaller than the curvature radius of each of the hair raising portions 40$c$B of the first and second bars. By setting the radius curvature of each hair raising portion 40$c$B of the hair raising bar smaller than those of the hair raising portions 40$c$B of the first and second bars as described above, the hair raising ability of the hair raising portion of the hair raising bar can be set higher than those of the hair raising portions of the first and second bars.

(Third Modification)

Figure 17:
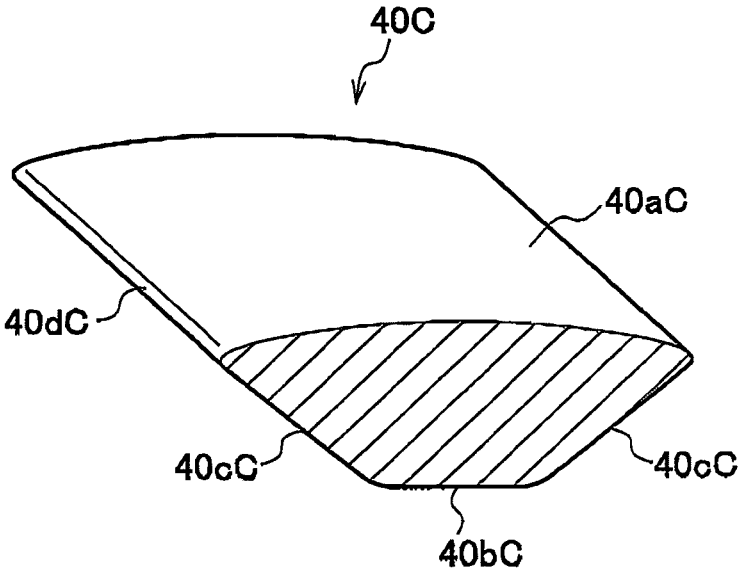
FIG. 17 is a cross sectional view of a bar according to a third modification of the first embodiment of the present invention.

As shown in FIG. 17, a bar 40C according to this modification is defined by a top surface (skin contact surface) 40$a$C which is curved convexly toward the skin 70 side (the upper side in FIG. 17) and comes into contact with the skin 70; a flat bottom surface 40$b$C formed on the inner blade 13 side (on the lower side in FIG. 17); and both side surfaces 40$c$C, 40$c$C smoothly connecting ends of the top surface (skin contact surface) 40$a$C and bottom surface 40$b$C in short-side direction. At the both ends of the upper part of the bar 40C, a pair of hair raising portions 40$d$C, 40$d$C are formed.

The aforementioned bar 40C can be used as each of the first, second, and hair raising bars in the same way as that of the first modification.

(Fourth Modification)

Figure 18:
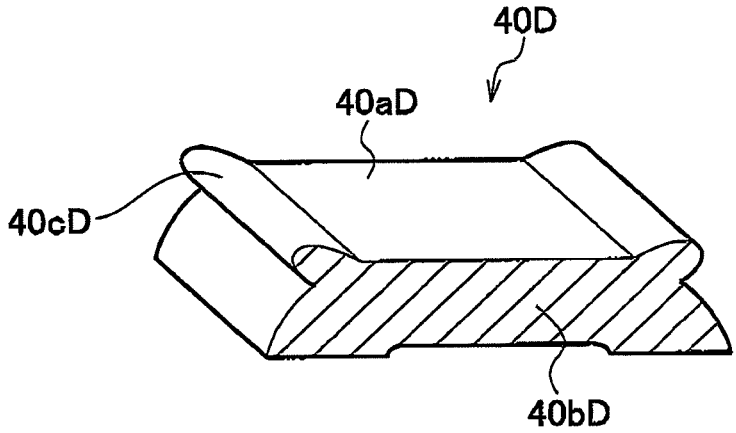
FIG. 18 is a cross sectional view of a bar according to a fourth modification of the first embodiment of the present invention.

As shown in FIG. 18, a bar 40D according to this modification includes a body portion 40$b$D having a substantially half-barrel shaped cross section. In the skin 70 side (in the upper side in FIG. 18) of the body portion 40$b$D, a substantially flat top surface (skin contact surface) 40$a$D coming into contact with the skin 70 is formed.

At the both ends of upper part of the body portion 40$b$D in the short-side direction, a pair of hair raising portions 40$c$D, 40$c$D are formed.

The aforementioned bar 40D can be used as each of the first, second, and hair raising bars in the same way as that of the first or second modification.

(Fifth Modification)

Figure 19:
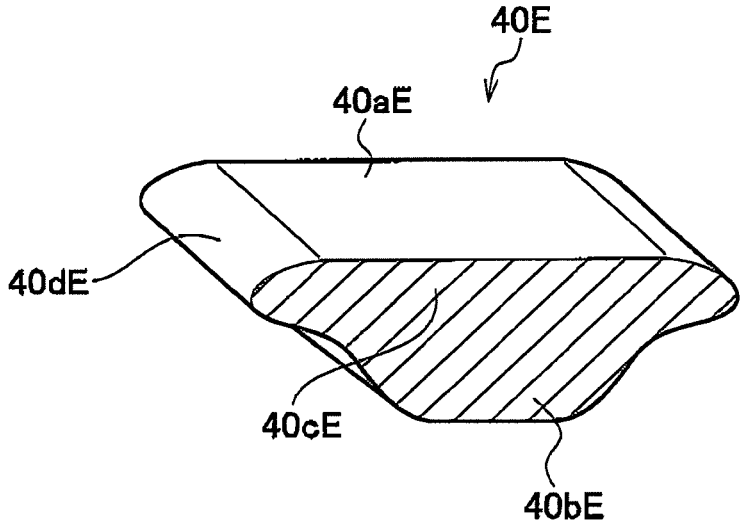
FIG. 19 is a cross sectional view of a bar according to a fifth modification of the first embodiment of the present invention.

As shown in FIG. 19, a bar 40E according to this modification includes a substantially plate-shaped body portion 40$c$E having a substantially flat top surface (skin contact surface) 40$a$E which is formed on the skin 70 side (in the upper side of FIG. 19) and comes into contact with the skin 70. At the bottom of the body portion 40$c$E, a protrusion 40$b$E extending downward is formed.

At the both ends of upper part of the body portion 40$c$E in the short-side direction, a pair of hair raising portions 40$d$E, 40$d$E are formed.

The aforementioned bar 40E can be used as each of the first, second, and hair raising bars in the same way as that of the second modification.

(Sixth Modification)

Figure 20:
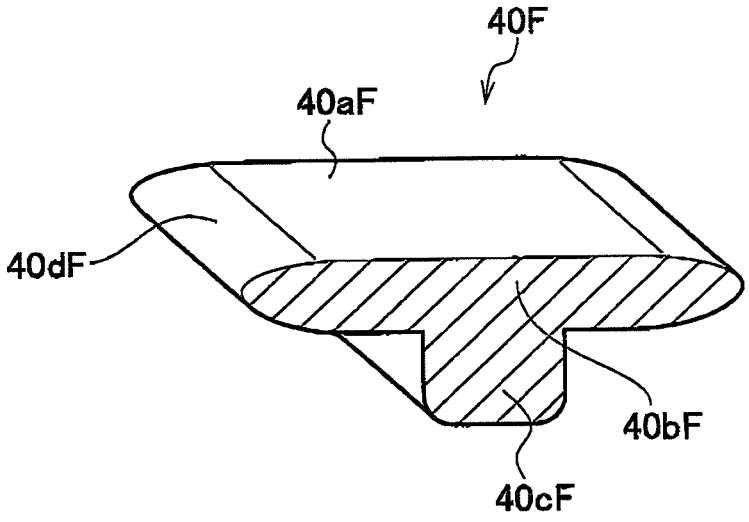
FIG. 20 is a cross sectional view of a bar according to a sixth modification of the first embodiment of the present invention.

A bar 40F according to this modification has a substantially T-shaped cross section. Specifically, as shown in FIG. 20, the bar 40F includes a substantially plate-shaped body portion 40$b$F having a substantially flat top surface (skin contact surface) 40$a$F which is formed on the skin 70 side (in the upper side of FIG. 20) and comes into contact with the skin 70. At the bottom of the body portion 40$b$F, a protrusion 40$c$F extending downward is formed.

At the both ends of the body portion 40$b$F in the short-side direction, a pair of hair raising portions 40$d$F, 40$d$F are formed.

The aforementioned bar 40F can be used as each of the first, second, and hair raising bars in the same way as that of the second modification.

(Seventh Modification)

Figure 21:
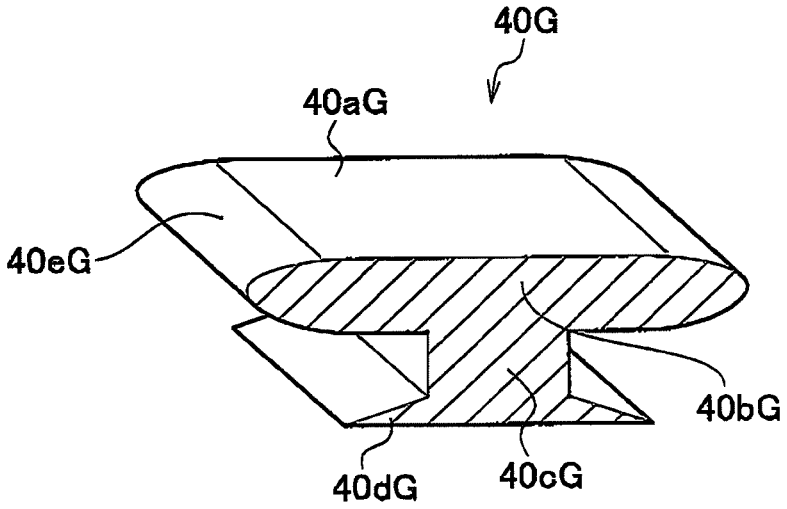
FIG. 21 is a cross sectional view of a bar according to a seventh modification of the first embodiment of the present invention.

A bar 40G according to this modification has a cross section of a substantially H shape turned sideways. Specifically, as shown in FIG. 21, the bar 40G includes a substantially plate-shaped body portion 40$b$G having a substantially flat top surface (skin contact surface) 40$a$G which is formed on the skin 70 side (in the upper side of FIG. 20) and comes into contact with the skin 70. At the bottom of the body portion 40$b$G, a protrusion 40$c$G extending downward is formed. Furthermore, at the bottom end of the protrusion 40$b$G, extensions 40$d$G, 40$d$G having triangular cross sections and extending toward the both ends in the short-side direction are formed.

At the both ends of the body portion 40$b$0 in the short-side direction, a pair of hair raising portions 40$e$G, 40$e$G are formed.

The aforementioned bar 40G can be used as each of the first, second, and hair raising bars in the same way as that of the second modification.

Second Embodiment

Figure 22A:
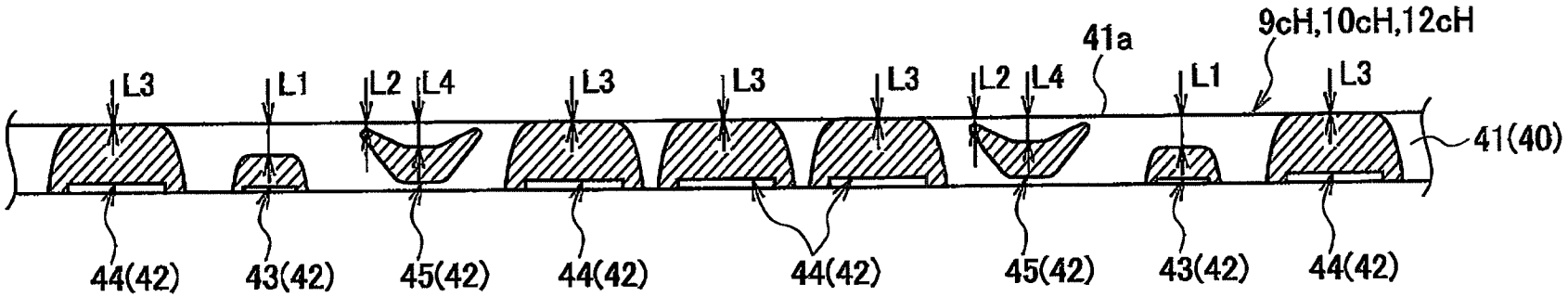
FIGS. 22A and 22B show a longitudinal arrangement of the bars according to the second embodiment of the present invention, FIG. 22A being an enlarged cross-sectional view of a part of a long plate member, FIG. 22B being an enlarged cross-sectional view of a part of an outer blade.
Figure 22B:
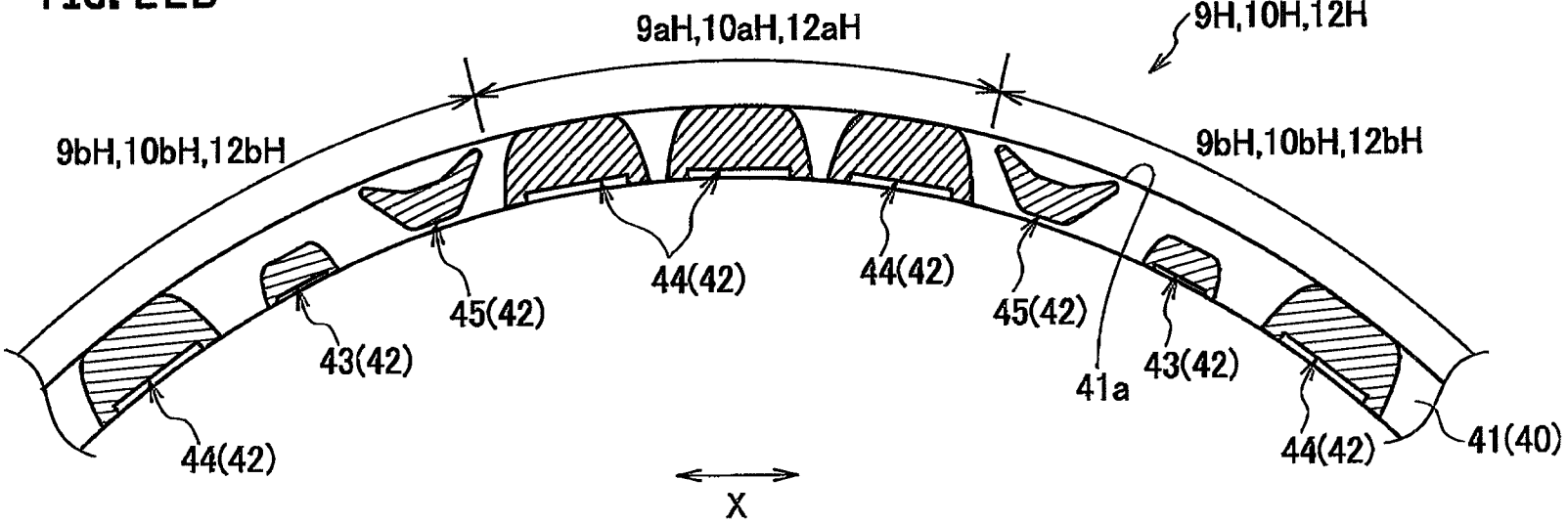
Figure 23:
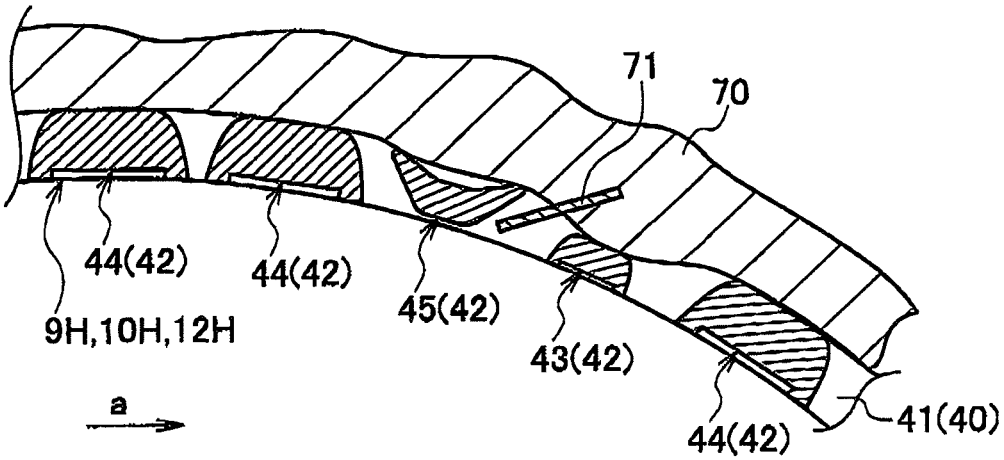
FIG. 23 is a cross-sectional view schematically showing a state where one of the hair raising bars according to the second embodiment of the present invention is raising a flat lying body hair.

As shown in FIG. 22, net blades 9H, 10H, and 12H according to a second embodiment have basically substantially the same configurations as those of the net blades 9, 10, and 12 according to the first embodiment.

Specifically, the net blades 9H, 10H, and 12H are respectively composed of long-plate members 9$c$H, 10$c$H, and 12$c$H including a number of blade holes 50 defined by the short-side bars 41 and longitudinal bars 42 (see FIG. 22A). Each of the long-plate members 9$c$H, 10$c$H, and 12$c$H is curved in an inverted U shape in the front-back direction (shaving direction) X convexly upward.

The longitudinal bars 42 (bars 40) include the longitudinal bars (hair raising bar) 45, the longitudinal bars (first bar) 43, and the longitudinal bars (second bars) 44. Each of the longitudinal bar 45 includes the hair raising portion 45$c$ having higher hair raising ability than that of the hair raising portions (in this embodiment, the hair raising portions correspond to the side surfaces 43$c$ and 44$c$) of the other bars (the longitudinal bars 43 and 44). Each longitudinal bar 43 includes the top surface 43$a$ positioned on the inner blade 13 side of the skin contact surface 45$j$ of each longitudinal bar (hair raising bar) 45. Each longitudinal bar 44 includes the top surface 44$a$ positioned on the skin 70 side of the skin contact surface 45$j$ of each longitudinal bar (hair raising bar) 45.

The longitudinal bars (first bars) 43, in which the top surface (skin contact surface) 43$a$ coming into contact with the skin 70 is positioned on the inner blade 13 side of the skin contact surfaces 45$j$ of each longitudinal bar (hair raising bar) 45, are individually provided adjacent to and forward of the respective longitudinal bars (hair raising bars) 45 in the short-side direction (the front-back direction; the shaving direction) X.

Specifically, the longitudinal bars (hair raising bars) 45 are provided at (inner) ends of the outside sections 9$b$H, 10$b$H, and 12$b$H on the top section side, the outside sections 9$b$H, 10$b$H, and 12$b$H extending on both sides of the top sections 9$a$H, 10$a$H, and 12$a$H in the short-side direction X, respectively. The longitudinal bars (first bars) 43 are provided adjacent to and outside of the respective longitudinal bars (hair raising bars) 45 in the short-side direction (the front-back direction; the shaving direction) X.

Furthermore, some of the longitudinal bars (second bars) 44, in each of which the top surface (skin contact surface) 44$a$ coming into contact with the skin 70 is positioned on the skin 70 side of the skin contact surfaces 45$j$ of each longitudinal bar (hair raising bar) 45, are provided adjacent to and outside of the respective longitudinal bars (first bars) 43, which are provided adjacent to the longitudinal bars (hair raising bars) 45, in the short-side direction (the front-back direction: the shaving direction) X.

Herein, in this embodiment, some of the longitudinal bars (second bars) 44 are provided in a part of each of the net blades 9H, 10H, and 12H with high contact pressure against the skin 70 (the top sections 9*a*H, 10*a*H, and 12*a*H), and the longitudinal bars (hair raising bars) 45 are provided in parts with low contact pressure (the outside sections 9*b*H, 10*b*H, and 12*b*H).

In this embodiment, moreover, the longitudinal bars (second bars) 44 are provided adjacent to and rearward of the respective longitudinal bars (hair raising bars) 45 in the shaving direction. As shown in FIG. 22, the longitudinal bars (second bars) 44 are provided at both ends of the top sections 9*a*H, 10*a*H, and 12*a*H in the short-side direction (the front-back direction; shaving direction).

In short, each of the longitudinal bars (hair raising bars) 45 is provided between one of the longitudinal bars (first bars) 43 and one of the longitudinal bars (second bars) 44.

According to the aforementioned embodiment, it is possible to provide substantially the same operation and effects as those of the first embodiment.

According to the second embodiment, since the top sections 9*a*H, 10*a*H, and 12*a*H are provided with the longitudinal bars (second bars) 44, the hair raising portions 45*c* can be further prevented from being excessively pressed into the skin 70. It is therefore possible to effectively reduce the influence (damage) of the hair raising portions 45*c* on the skin 70.

According to the second embodiment, the longitudinal bars (second bars) 44 are provided adjacent to and rearward of the respective longitudinal bars (hair raising bars) 45 in the shaving direction. Accordingly, when the electric shaver 1 is in use, the hair raising portions 45*c* can be further pressed into the skin 70, so that the flat lying body hair 71 can be raised more efficiently.

Third Embodiment

In a third embodiment, a rotary electric shaver to which the present invention is applied will be described.

An electric shaver 1I according to the third embodiment differs from the first embodiment in including an inner blade 13I composed of a rotary blade.

The electric shaver 1I includes an outer blade 8I and the inner blade 13I which is provided inside of the outer blade 8I (under the outer blade 8I) and move relative to the outer blade 8I. These outer blade 8I and inner blade 13I are both circular. The inner blade 13I rotates in a rotation direction (a direction b) relative to the outer blade 8I fixed to the body. The body hair 71 inserted into one of the blade holes 50 of the outer blade 81 is cut by the outer blade SI in cooperation with the inner blade 13I.

Figure 24:
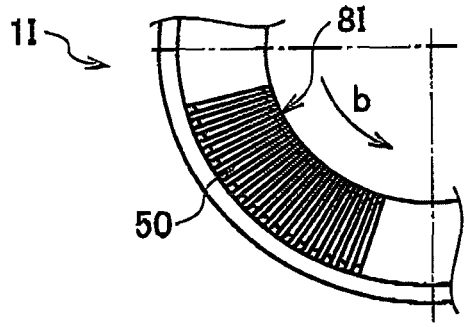
FIG. 24 is an enlarged plan view of a part of an electric shaver according to a third embodiment of the present invention.

In this embodiment, the lot of blade holes 50 each having a substantially rectangular shape long in the radial direction are provided in a radial fashion. As shown in FIG. 24, the blade holes 50 are defined by a number of bars 40I extending in a radial fashion. The bars 40I include first bars 43I and hair raising bars 45.

Figure 25A:
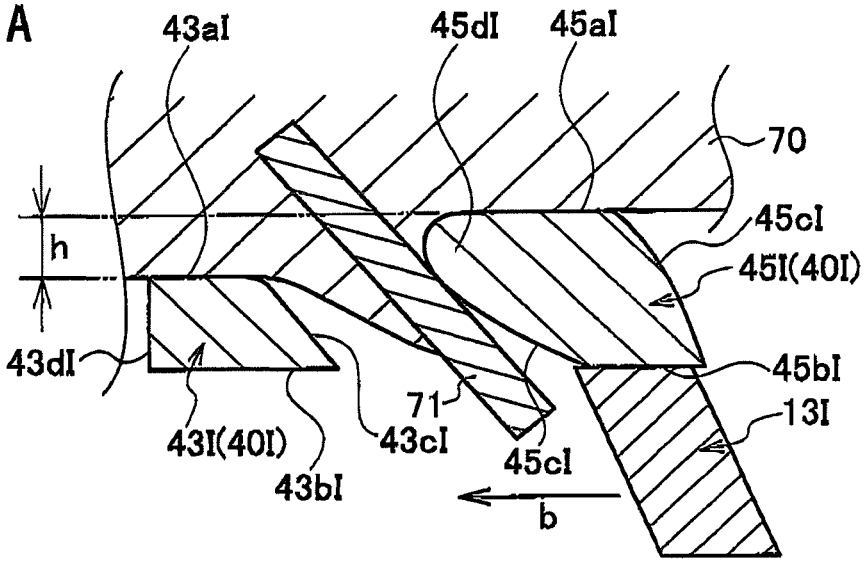
FIGS. 25A and 25B schematically illustrate a process where a lying body hair is being cut by an inner blade and an outer blade according to the third embodiment of the present invention, FIG. 25A being a cross-sectional view schematically showing a state where the hair raising portion is raising the lying body hair, FIG. 25B being a cross-sectional view showing a state where the body hair is cut.
Figure 25B:
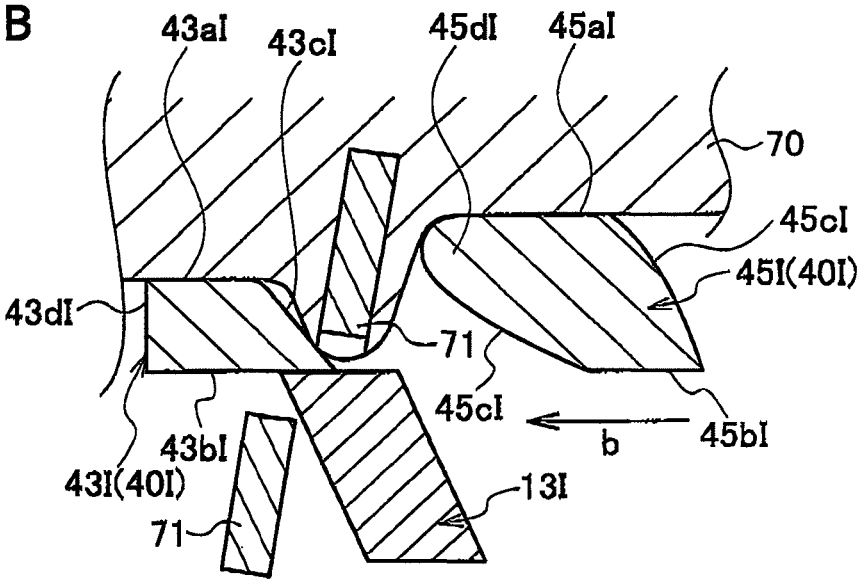

Each of the hair raising bars 45I is defined by: a substantially flat top surface (skin contact surface) 45*a*I which is formed on the skin 70 side (on the upper side in FIG. 25) and comes into contact with the skin 70; a flat bottom surface 45*b*I formed on the inner blade 13I side (on the lower side in FIG. 25); and both side surfaces 45*c*I, 45*c*I smoothly connecting the ends of the top surface (skin contact surface) 45*a*I and bottom surface 45*b*I. In upper part of the hair raising bar 45I, a hair raising portion 45*d*I protruding forward in the shaving direction (the rotation direction of the inner blade 13I; the direction b in this embodiment) is formed.

Moreover, each of the first bars 43I is formed to have a substantially right-angled trapezoidal cross-section which is defined by a substantially flat top surface (skin contact surface) 43*a*I which is formed on the skin 70 side (on the upper side in FIG. 25) and comes into contact with the skin 70; a flat bottom surface 43*b*I formed on the inner blade 13I side (on the lower side in FIG. 25); an inclined surface 43*c*I connecting the rear ends of the top surface (skin contact surface) 43*a*I and bottom surface 43*b*I in the rotation direction (the direction substantially b); and a side surface 43*d*I extending substantially vertically and connecting the front ends of the top surface (skin contact surface) 43*a*I and bottom surface 43*b*I in the rotation direction (the direction b).

In this embodiment, the side surface 43*d*I corresponds to the hair raising portion. This side surface 43*d*I is designed so as to have a lower hair raising ability than that of the hair raising portion 45*d*I.

Furthermore, in this embodiment, the top surface (skin contact surface) 45*a*I of the hair raising bar 45I is protruded outward by h from the top surface (skin contact surface) 43*a*I of the first bar 43*a*I. The top surface (skin contact surface) 43*a*I of the first bar 43*a*I is therefore positioned on the inner blade 13I side of the hair raising portion 45*d*I of the hair raising bar 45I.

As described above, also in this embodiment, the first bar 43*a*I, in which the top surface (skin contact surface) 43*a*I is positioned on the inner blade 13I side of the hair raising portion 45*d*I of the hair raising bar 45I, is provided adjacent to and forward of each hair raising bar 45I in the shaving direction (the direction b).

According to the aforementioned embodiment, it is possible to provide the same operation and effects as those of the first embodiment.

Hereinabove, the preferred embodiments of the present invention are described. However, the present invention is not limited to the aforementioned embodiments, and various modifications can be made.

For example, the first and second embodiments show the example where some bars having a substantially equal hair raising ability are provided in each top section. However, the hair raising portions of the bars in each top section may be arranged in ascending order of the hair raising ability starting from the center in the right-left direction toward each end.

Moreover, the shapes of the bars are not limited to those shown in the embodiments and modifications and can be varied. Furthermore, each of the first, second, and hair raising bars can be composed of a bar of a shape arbitrarily selected from various shapes including the shapes shown in the embodiments and modification. If the first and second bars are composed of bars of a same shape, the first and second bars need to be positioned with a vertical offset (on the skin side and on the inner blade side).

The first and second embodiments include four outer blades arranged side by side. The number of the outer blades may be 1 to 3 or more than 4.

In the first and second embodiments, each of the three net blades is provided with the hair raising bars. However, the hair raising bars only needs to be provided for at least any one of the outer blades including the slit blade.

In the first and second embodiments, the outer blades are provided for the head section fixed to the grip section. However, the outer blades may be provided for the grip section.

In the third embodiment, the single circular outer blade is provided. However, the present invention is not limited to this and can be applied to an electric shaver provided with two or more circular outer blades.

Moreover, the detailed specifications (the shape, size, layout, and the like) of the outer and inner blades, bars, and the like can be properly changed.

What is claimed is:

1. An electric shaver, comprising:

an outer blade including blade holes defined by bars; and an inner blade which is provided inside of the outer blade and moved relative to the outer blade to cut body hair inserted into the blade holes, wherein the bars include a hair raising bar having a hair raising portion raising the body hair and a first bar having a skin contact surface positioned at a greater depth, with respect to an outermost surface of the outer blade, than a skin contact surface of the hair raising bar, and a second bar having a skin contact surface positioned at a greater height, with respect to the outermost surface of the outer blade, than the skin contact surface of the hair raising bar wherein the first bar is provided adjacent to and forward of the hair raising bar.

2. The electric shaver according to claim 1, wherein the outer blade has a curved inverted U-shape inducting a top section and an outside section, and the hair raising bar is provided in the outside section of the outer blade.

3. The electric shaver according to claim 2, wherein the first bar is provided in the top section.

4. The electric shaver according to claim 2, wherein the second bar is provided in the top section.

5. The electric shaver according to claim 1, wherein the first bar comprises a plurality of first bars, and wherein one of the first bars is provided adjacent to and rearward of the hair raising bar.

6. The electric shaver according to claim 1, wherein the second bar is provided adjacent to and rearward of the hair raising bar.

* * * * *